US007068186B2

(12) United States Patent
Hill et al.

(10) Patent No.: US 7,068,186 B2
(45) Date of Patent: Jun. 27, 2006

(54) TRAFFIC MONITORING

(75) Inventors: David John Hill, Dorchester (GB); Sean Dormer Thomas, Dorchester (GB)

(73) Assignee: Qinetiq Limited (GB)

( * ) Notice: Subject to any disclaimer, the term of this patent is extended or adjusted under 35 U.S.C. 154(b) by 260 days.

(21) Appl. No.: 10/468,064

(22) PCT Filed: Feb. 12, 2002

(86) PCT No.: PCT/GB02/00618

§ 371 (c)(1),
(2), (4) Date: Aug. 14, 2003

(87) PCT Pub. No.: WO02/065426

PCT Pub. Date: Aug. 22, 2002

(65) Prior Publication Data

US 2004/0061628 A1 Apr. 1, 2004

(30) Foreign Application Priority Data

Feb. 15, 2001 (GB) ..... 0103665.6

(51) Int. Cl.
*G08G 1/01* (2006.01)

(52) U.S. Cl. ..... 340/942; 701/117; 398/151; 398/165

(58) Field of Classification Search ..... 340/933–943; 200/86 R, 86 A, 85 R; 359/234–236, 6, 359/11; 385/10, 2; 455/506; 398/98, 84, 398/87, 135–172; 701/117–122
See application file for complete search history.

(56) References Cited

U.S. PATENT DOCUMENTS 4,092,059 A * 5/1978 Hawkes et al. ..... 385/46
5,883,585 A * 3/1999 Akutsu et al. ..... 340/933

FOREIGN PATENT DOCUMENTS

GB 2214771 9/1989

* cited by examiner

*Primary Examiner*—Jeffery Hofsass
*Assistant Examiner*—Jennifer Stone
(74) *Attorney, Agent, or Firm*—McDonnell Boehnen Hulbert & Berghoff LLP

(57) ABSTRACT

The present invention provides an optical fiber sensor for traffic monitoring, which comprises a former consisting of an elongated plate, and an optical fiber wound onto at least one surface of the elongated plate. The elongated plate is flexible in a direction transverse to the at least one predetermined property of an optical signal transmitted through the optical fiber sensor. The resulting sensor has a reduced depth which makes it easier to locate within the surface of a traffic route, has increased flexibility to enable to confirm to the surface of the traffic route, and has good cross axis sensitivity rejection.

11 Claims, 13 Drawing Sheets

TRAFFIC MONITORING

FIELD OF THE INVENTION

This invention relates to traffic monitoring techniques, and in particular to sensors used in traffic monitoring systems.

BACKGROUND OF THE INVENTION

It will be appreciated by those skilled in the art that traffic may come in many different forms. For example, considering solely traffic on land, such traffic can take a variety of forms, including but not limited to vehicles on roads, bicycles on paths, trains on rails, people on paths, aircraft on runways, etc.

There are several reasons why information regarding traffic on a particular section of a traffic route (for example a road, a path, a railway line, etc) may be collected. One of these may be for the effective management of traffic, where information regarding the speed and volume of traffic is useful. This enables alternative routes to be planned in response to accidents or route closures and to attempt to relieve congestion, perhaps by altering speed limits.

Considering the example of roads, many new roads are built with a sacrificial top layer which is designed to wear out and be replaced. The significant costs associated with road repairs and road building, in addition to the disruption caused by such works, requires that repairs are carried out only when needed. The sacrificial layer should neither be replaced too soon, leading to unnecessary costs, nor too late, risking more serious damage to the underlying structure of the road. An accurate determination of the volume of traffic on a particular road section is therefore essential.

A further reason why traffic information is required is for the enforcement of regulations and laws. There are regulations relating to maximum allowable weights for heavy goods vehicles (HGVs) which are borne out of concerns for safety and also to lessen the damage that overladen vehicles may do to the road structure. A measure of dynamic vehicle weight helps to ensure that such regulations are adhered to. This also applies to other forms of traffic route, for example to the issue of overweight trains on particular railway routes. Particular lines may be approved for use by trains up to a certain weight maximum, and the rail operators should adhere to these weight restrictions. Again, the ability to measure dynamic weight would help to ensure that such regulations are adhered to.

Simple information regarding vehicle speed may be used to monitor and enforce speed limits.

There may also be a requirement to collect information regarding the types of vehicle using a particular section of road. This may be to prevent unsuitable vehicles such as HGVs from using rural roads or to plan future road building schemes. Classification of vehicle type may be achieved from a determination of dynamic vehicle weight and axle count.

It is clear that information regarding the speed, weight, volume and type of traffic can also be used to help with an effective traffic management programme. There are several methods in use to obtain this information, however these have associated problems.

Many sections of road are overseen by video cameras. The images from these cameras are fed to central points to be analysed to provide information regarding vehicle speed and type and traffic volume. However, due to the complexity of the images, it is not always possible to reliably automate the analysis of the data received, meaning that they must be studied visually. There is a limit to how many images can be analysed in this way. Furthermore, the quality of the images collected may be influenced by weather conditions. Fog or rain can obscure the field of view of the cameras, as can high vehicles, and high winds can cause the cameras to vibrate. In many countries, camera systems are operated by law enforcement agencies, so there is often an added complication in making the information collected available to the agencies involved with traffic management. It is also not possible to determine the weight of a vehicle from a video image. The commissioning costs of video camera systems for traffic monitoring can also be high.

The vast majority of new roads and large numbers of existing roads are provided with inductive sensors. These are wire loops which are placed below the road surface. As a vehicle passes over the sensor, the metal parts of the vehicle, i.e. the engine and the chassis, change the frequency of a tuned circuit of which the loop is an integral part. This signal change can be detected and interpreted to give a measure of the length of a passing vehicle. By placing two loops in close proximity to one another, it is also possible to determine the vehicle's speed. The quality of the data collected by inductive loop sensors is not always high and is further compromised by the fact that the trend in many modern vehicles is to have fewer metal parts. This leads to a smaller signal change which is more difficult to interpret. In addition, because of a tendency for road builders to make greater use of steel in highway construction, there is an increasing problem of interference affecting the accuracy of readings.

Although cheap to produce, inductive sensors are large and as such their placement, particularly in existing roads, causes significant disruption. This has associated costs. A major drawback with the use of inductive loops for traffic management is that they are not amenable to multiplexing. Each sensor site requires its own data collection system, power supply and data communication unit. This increases the cost of the complete sensor significantly, which results in the majority of installed inductive loops not being connected, and therefore incapable of collecting data. Furthermore, although inductive loops can be used to count vehicles and, if deployed in pairs, to determine vehicle speed, they cannot be used to measure dynamic vehicle weight. Vehicle classification is thus not possible.

Two methods for determining the weight of vehicles, in particular HGVs are in common use. Vehicle weight can be measured using a weigh-bridge. This is very accurate but requires the vehicle to leave the highway to a specific location where the measurement can take place. An alternative method is to attempt to measure the weight of the vehicle as it is in transit. Commonly, piezo-electric cables are placed under the surface of the road, which produce a signal proportional to the weight of the vehicle as it passes over. This method is more convenient but less accurate than a weigh-bridge. As with inductive loop sensors, piezo-electric sensors are not amenable to multiplexing so each requires a similar data collection system, power supply and data communication unit. The sensors are also more expensive and less robust than inductive loop sensors.

In order to obtain the maximum amount of information regarding traffic on a particular section of road, piezo-electric sensors are often deployed in tandem with inductive loops.

Optical fibre sensors can be used to detect pressure. When a length of optical fibre is subjected to an external pressure the fibre is subjected to a strain. This strain imposes a change in property (e.g. phase) in an optical signal propagating through the optical fibre due to a combination of the physical length change and the stress-optic effect, and this change in property can be detected. As it is possible to analyse for very small changes in property such as phase, optical fibre sensors are extremely sensitive to applied pressure. This high sensitivity allows optical fibre sensors to be used, for example, in acoustic hydrophones where sound waves with intensities equivalent to a pressure of $10^{-4}$ Pa are routinely detectable. Such high sensitivity can however also cause problems. Optical fibre sensors are not ideally suited for use in applications where a low sensitivity is required, for example for detecting gross pressure differences in an environment with high background noise. However, optical fibre sensors have the advantage that they can be multiplexed without recourse to local electronics.

It would be desirable to provide a sensor for traffic monitoring which would be easily deployed, would provide the required accuracy and could be multiplexed with other sensors to simplify data collection, data communication and power supply.

SUMMARY OF THE INVENTION

Viewed from a first aspect, the present invention provides an optical fibre sensor for traffic monitoring, comprising: a former comprising an elongate plate; and an optical fibre would onto at least one surface of the elongate plate, the elongate plate being flexible in a direction transverse to the at least one surface such that passage of traffic over the optical fibre sensor is arranged to cause a variation in at least one predetermined property of an optical signal transmitted through the optical fibre sensor.

In accordance with the present invention, an optical fibre is wound onto at least one surface of an elongate plate, such that when traffic passes over the sensor this causes a variation in at least one property of an optical signal transmitted through the fibre, which can then be detected by an appropriate interrogation system.

Since an elongate plate is used to hold the optical fibre, the optical fibre sensor can be made sufficiently thin that it can be readily deployed in a traffic route without having to dig a substantial groove in the traffic route to accommodate the sensor. Further, due to the flexibility of the elongate plate, the sensor can readily be made to adopt the shape of the traffic route surface, and hence can for example adopt the shape of the camber of a highway surface, thus making it simple to ensure that the sensor is at a uniform depth below the surface. This helps to improve the uniformity of response along the length of the sensor, and hence improve the accuracy available from the sensor. Furthermore, since the sensor is based on optical fibre technology, it is possible to multiplex a plurality of such optical fibre sensors together to thereby enable a simplification in the data collection, data communication and power supply systems. In addition, this type of sensor is easy to store and deploy. It may be wound onto a spool for storage and transportation, and then unwound as required.

In preferred embodiments, the elongate plate is provided with a pair of curved elements which protrude from the at least one surface and are spaced from each other along the elongate axis, wherein the optical fibre is wound longitudinally between the curved elements. Hence, in such preferred embodiments, the optical fibre traverses up and down the elongate axis of the elongate plate, and at the end of each traversal passes around the curved element prior to traversing back along the elongate axis in the opposite direction. When an optical fibre is bent, there is a tendency for light to be lost from the optical fibre. By ensuring that the optical fibre passes around a curved element of appropriate dimensions, this ensures that excessive light loss does not occur as the optical fibre is bent in order to enable it to traverse in opposite directions the elongate plate. It will be appreciated by those skilled in the art that the appropriate dimensions for the curved surface, for example its radius, will depend on the optical fibre being used. In preferred embodiments, an optical fibre with a high Numerical Aperture (NA) is chosen, thereby increasing the amount by which the optical fibre can be bent before excessive light loss starts to occur. In such embodiments, it has been found that providing curved elements with a diameter of 8 mm is sufficient to allow the optical fibre to the passed up and down the length of the elongate plate without excessive light loss as the optical fibre is bent to change direction.

It will be appreciated that the curved elements may be moulded as part of the elongate plate itself, or alternatively could be provided as separate elements for fitting in an appropriate manner to the elongate plate. In embodiments where the curved elements are separate elements to be fitted to the elongate plate, it will be appreciated that they may be fitted in a way in which they are fixed, or alternatively may be attached to the elongate plates so that they are rotatable. In one embodiment, each curved element is rotatable about an axis transverse to the at least one surface of the elongate plate. By allowing the curved element to rotate, this enables the strain on the various lengths of optical fibre passing between the curved elements to be equalised.

In preferred embodiments, each curved element comprises a spindle, which is preferably attached to the elongate plate such that it protrudes from the at least one surface in a direction substantially perpendicular to the surface. In one embodiment, the spindle is rotatable. However, in preferred embodiments, the spindle is fixed, and the curved element further comprises a wheel rotatably mounted on the spindle.

For ease of handling and deployment, it is desirable that the spindles are short in comparison to the length of the strip. An example sensor may have a length of approximately 3.5 m, with a depth of approximately 5 mm (the spindles therefore being less than or equal to 5 mm in length). This is sufficient to wind the required length of optical fibre, yet results in a sensor which is thin enough to remain flexible.

It will be appreciated that the curved elements may be located at any appropriate point along the surface of the elongate plate. However, the sensitivity of the optical fibre sensor is generally increased the longer the length of optical fibre used within the sensor. Accordingly, to make best use of the length of the elongate plate, it is preferable that the pair of curved elements are located towards opposing ends of the elongate plate.

In preferred embodiments, the optical fibre sensor further comprises a pair of termination plates provided towards opposing ends of the elongate plate, each termination plate being coupled to a corresponding one of the curved elements so as to guide the optical fibre to and from that curved element. In preferred embodiments, each termination plate is arranged to receive the curved element, and is shaped so as to guide the optical fibre to and from that curved element. In one preferred embodiment, the optical fibre is arranged to follow a predetermined path on the at least one surface between the pair of curved elements, and the termination plate serves to provide a smooth transition for the optical fibre between that predetermined path and the outer periphery of the curved element.

It will be appreciated that the elongate fibres may be left to follow their natural route along the at least one surface between the pair of curved elements. However, in preferred embodiments the optical fibre sensor further comprises one or more guide members protruding from the at least one surface of the elongate plate and positioned between the pair of curved elements, the guide members being arranged to guide the optical fibre along a predetermined path on the at least one surface between the pair of curved elements. This ensures that the fibres can be kept away from an edge region of the at least one surface, and accordingly reduces the risk of damage to the optical fibres. Preferably, the predetermined path is a central path along the elongate axis of the elongate plate.

As an alternative to embodiments which include spindles, and/or wheels on the elongate plate, the optical fibre can instead be wound longitudinally around the long axis of the elongate plate so as to pass along both surfaces of the elongate plate. In yet another alternative design, the optical fibre is wound helically around the short axis of the elongate plate.

Preferably, the optical fibre sensor further comprises a coating provided over the elongate plate and optical fibre. This coating may serve to protect the optical fibre from damage, and may for example be formed of a material such as epoxy, polyurethane or Butyl rubber. In preferred embodiments, the coating is provided not merely to protect the optical fibre from damage, but also to de-sensitise it. Accordingly, in such preferred embodiments, the coating comprises a compliant compound for reducing the sensitivity of the optical fibre sensor. In this embodiment, the compliant material effectively adsorbs a proportion of any applied force, thereby enabling the sensor to be used to detect larger forces and pressures than would ordinarily be possible with optical fibre sensors. The choice of compliant compound may vary from a highly compliant material, such as grease, to a less compliant material such as epoxy, polyurethane or Butyl rubber.

As mentioned above, dependent on the choice of coating applied to the elongate plate and optical fibre, the coating itself may provide appropriate protection for the optical fibre. However, in preferred embodiments, the optical fibre sensor further comprises an additional elongate plate, the coating being sandwiched between the elongate plate and the additional elongate plate. This arrangement not only provides additional protection for the optical fibre sandwiched between the two elongate plates, but also provides the sensor with symmetry, such that the optical fibre passes generally through the centre of the optical fibre sensor.

In preferred embodiments, the elongate plate comprises a metal strip. Examples of suitable metals include steel, brass, tin alloys, aluminium alloys, etc. Alternatively, the elongate plate comprises a non-metal strip, for example a plastic such as Perspex and high density polyethylene, or alternatively nylon or some composite materials.

The elongate strip may preferably be of any suitable dimensions provided that it remains sufficiently flexible to be able to adopt the shape of the traffic route surface. A typical example may have a long axis of 3 to 3.5 m, a short axis of 1 to 2 cm and a thickness of 0.5 to 1 mm.

Preferably, the optical fibre sensor further comprises a semi-reflective element coupled to at least one end of the optical fibre. For a single, isolated sensor a semi-reflective end is used at either end of the sensor. However, more commonly a number of sensors are connected in series so that each individual sensor need have only one semi-reflective element. In this case, each semi-reflective element acts as the first semi-reflective element for one sensor and also as the second semi-reflective element for the preceding sensor. The exception to this is the last sensor in a series, which requires an additional, terminal semi-reflective element.

Suitably, the semi-reflective element is either a fibre optic X-coupler with one port mirrored, or a Bragg grating.

It will be appreciated that the at least one predetermined property of the optical signal that is varied dependent on the passage of traffic over the optical fibre sensor may take a variety of forms, dependent on the construction of the optical fibre sensor, and for example may be phase, amplitude, polarisation, etc. In preferred embodiments, the predetermined property is phase, and the variation in phase is detected by an interferometric interrogation system.

In accordance with a second aspect of the present invention a traffic monitoring system comprises: at least one sensor station; and an optical interrogation system; wherein the at least one sensor station comprises at least one optical fibre sensor in accordance with the first aspect of the present invention, the at least one optical fibre sensor being deployable in a traffic route; wherein the optical interrogation system is adapted to respond to the variation in said at least one predetermined property produced in the at least one optical fibre sensor due to a force applied by a unit of traffic passing the at least one sensor station.

This provides a low cost, reliable traffic monitoring system which can be highly multiplexed. Remote interrogation is possible so neither local electronics nor local electrical power are required.

Preferably, the optical interrogation system is an interferometric interrogation system, and the variation in said at least one predetermined property is an optical phase shift.

In preferred embodiments, the interferometric interrogation system comprises a reflectometric interferometric interrogation system, more preferably the interferometric interrogation system comprises a pulsed reflectometric interferometric interrogation system or architecture.

In a system where time division multiplexing is used to distinguish individual sensors, reflectometric and particularly, pulsed reflectometric interferometry allow for a very efficient multiplexing architecture that can be used with distributed sensors.

Alternatively, the interferometric interrogation system comprises a Rayleigh backscatter interferometric interrogation system, with a pulsed Rayleigh backscatter interferometric interrogation system being particularly preferred.

A non-Rayleigh backscattering reflectometric system relies upon discrete reflectors between sensors. These are comparatively expensive components, which may add to the cost of the overall system. In contrast, Rayleigh backscattering relies on reflection of light from inhomogeneities in the optical fibre. This removes the need for discrete reflectors, reducing the overall cost of the system. However, the data collected from such a system requires more complex analysis than a reflectometric interrogation system.

Preferably, the system comprises a plurality of sensor stations, wherein adjacent stations are connected together by a length of optical fibre.

The length of optical fibre connecting adjacent sensor stations defines the optical path length between adjacent sensor stations. Commonly, the connecting optical fibre is extended, and as such that the optical path length between adjacent sensor stations is substantially equal to their physical separation. However, the connecting optical fibre need not be fully extended, in which case the physical separation of adjacent sensor stations may be any distance up to that of the length of the optical fibre used to connect adjacent sensor stations.

Conveniently, the length of optical fibre connecting adjacent sensor stations is between 100 m and 5000 m.

Preferably, each sensor station comprises a plurality of fibre optic sensors, more preferably, each sensor station comprises at least one fibre optic sensor per lane of the traffic route.

Most preferably, each sensor station comprises at least two optical fibre sensors, separated from each other by a known distance, per lane of the traffic route. Separated pairs of sensors can be used to determine traffic speed.

Suitably, the known distance is between 0.5 m and 5 m. The known distance refers to the physical separation of the fibre optic sensors and not to the optical path length of the optical fibre between each sensor.

This provides a traffic monitoring system which can be employed to monitor traffic on any type of traffic route, from a single lane road, railway line, path, etc, to a multi-lane motorway. The sensor stations may be sited at intervals along the entire length of the traffic route or only on sections where traffic monitoring is crucial, for example at known congestion sites or accident blackspots.

Considering the example of a highway as the traffic route, ensuring that each lane of the highway has at least one fibre optic sensor means that some traffic information can be collected irrespective of the part of the highway on which traffic is flowing. The simplest system for a single lane highway would have two sensors, one for each direction of traffic. Although this would give information regarding vehicle weight, traffic volume and axle count, it could not be used to give a measure of vehicle speed. Vehicle speed may however be determined by placing two sensors, separated by a known, short distance, per lane of the highway. It may be desirable to place more than two sensors per lane of the highway, for example three sensors placed in close proximity to each other may be used to give a measure of vehicle acceleration. Such a measurement may be of use at road junctions, roundabouts or traffic lights.

Preferably, each sensor is deployed so that its longest dimension is substantially in the plane of the traffic route and substantially perpendicular to the direction of traffic flow on the traffic route.

Preferably, the longest dimension of each sensor is substantially equal to the lane width of the traffic route.

This helps to ensure that the passage of any vehicle on any part of the highway is registered by the system.

Considering the example of a highway as the traffic route, in the UK the width of a lane of highway may range from around 2.5 m for a minor road up to around 3.65 m for a motorway. Other parts of the world may have road systems of differing lane widths.

Preferably, each sensor is deployed beneath the surface of the traffic route.

As an example, for deployment in an existing road, a thin channel or groove can be cut in the road to accommodate each sensor. The groove may then be refilled and the surface of the road made good again. Clearly, in the case of a new road the sensors can simply be incorporated into the structure of the road during construction.

It is possible, but less preferred to deploy the sensors so that they are attached to the surface of the highway rather than embedded in it. This may be useful if the system is to be used for a short time in a particular location before being moved. Clearly, in this instance the sensors employed may need to be protected or be strong enough to be able to withstand the greater forces associated with vehicles passing directly over them.

Preferably, the optical fibre sensor comprises a sensing fibre coupled to a dummy fibre; wherein the optical path length of the sensing fibre is such that the sensitivity of the sensor is low; and wherein the optical path length of the dummy fibre is greater than that of the sensing fibre such that the combined optical path length of the sensing fibre and the dummy fibre is sufficient to allow the sensor to be interrogated by an optical interrogation system, such as a pulsed interferometric interrogation system.

Preferably, the optical path length of the dummy fibre is at least 2 times greater than that of the sensing fibre. However, it will be appreciated that the dummy fibre does not necessarily have to be at least twice the length of the sensing fibre. It could be longer or shorter as needed providing the sensor fibre plus dummy fibre length is long enough to be interrogated by the width of the smallest interrogation pulse generated by the switches in the pulse reflectometric architecture.

The sensitivity of an optical fibre sensor is substantially proportional to the length of the optical fibre it contains. The length of the sensing section is preferably short in order to reduce the sensitivity of the sensor to a level where a reliable measurement of the large forces associated with vehicle traffic is possible. However, a short section of optical fibre cannot easily be interrogated using a pulsed interferometric system. This is because the minimum pulse length is limited by optical switch performance. By using a dummy fibre, the total optical path length of the sensor is increased so that pulsed interferometric interrogation is made simpler.

Preferably, the sensing fibre is substantially straight.

Preferably, the sensing fibre and the dummy fibre comprise sections of a single optical fibre. This simplifies the construction of the sensor. Alternatively, the sensing fibre and the dummy fibre may be spliced together or joined by any other suitable means.

Preferably, the sensor further comprises a casing substantially surrounding at least one of the sensing fibre and the dummy fibre.

In the case of the optical fibre sensor comprising a sensing section and a dummy section, if a semi-reflective element is included, then preferably that semi-reflective element is located on the dummy section of the optical fibre sensor.

In accordance with a third aspect of the present invention, a method for monitoring traffic comprises providing a plurality of sensor stations on a traffic route; deploying a plurality of optical fibre sensors in accordance with the first aspect of the present invention at each sensor station; interfacing each optical fibre sensor to an optical interrogation system; employing time division multiplexing such that the interrogation system is adapted to monitor an output of each optical fibre sensor substantially simultaneously; and using the output of each optical fibre sensor to derive data relating to the traffic passing each sensor station.

Preferably, the method further employs wavelength division multiplexing such that the number of optical fibre sensors which the interrogation system is adapted to monitor is increased.

Preferably, the method further employs spatial division multiplexing such that the number of optical fibre sensors which the interrogation system is adapted to monitor is increased.

Preferably, the data derived relates to at least one of vehicle speed, vehicle weight, traffic volume, axle separation and vehicle classification. The weight is determined by calculating the area under the axle response (phase change) curve. Amplitude and width (freq) of this curve are determined by the vehicle speed as well as the weight. Calibrated weights are calculated by multiplying the area under the curve by the speed times a scale factor, with the speed being determined by the peak signal separation time between each of the two sensors in a pair.

BRIEF DESCRIPTION OF THE DRAWINGS

The invention will now be described by way of example only with reference to the following drawings in which.

DESCRIPTION OF PREFERRED EMBODIMENTS

As mentioned previously, traffic may come in many different forms. For example, considering solely traffic on land, such traffic can take a variety of forms, including but not limited to vehicles on roads, bicycles on paths, trains on rails, people on paths, aircraft on runways, etc. For the purpose of illustrating embodiments of the present invention, traffic consisting of vehicles on a highway will be considered.

Figure 1:
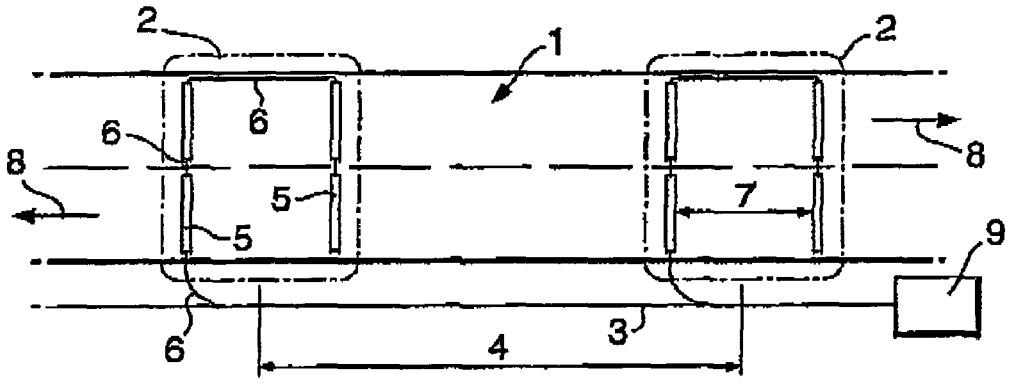
FIG. 1 shows example of a section of a traffic monitoring system according to an embodiment of the present invention in place on a two lane highway.
Figure 2:
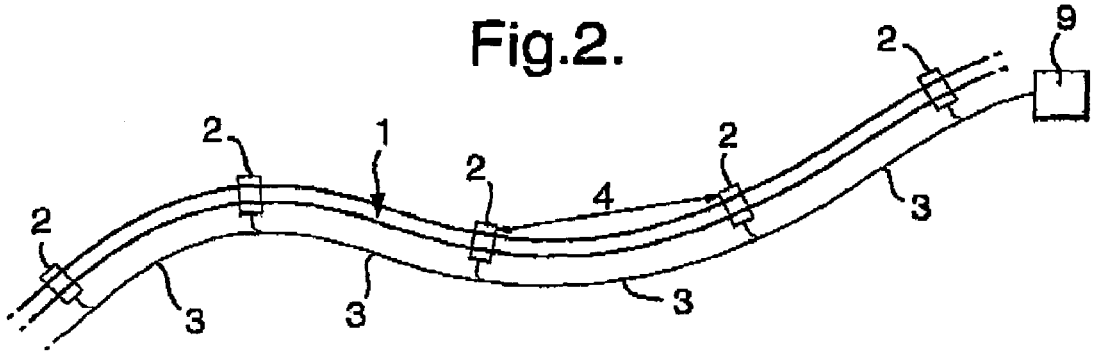
FIG. 2 shows an extended section of a traffic monitoring system according to an embodiment of the present invention.

FIG. 1 shows a section of a traffic monitoring system in place on a two lane highway 1. Two sensor stations 2 are shown connected by a length of optical fibre 3. In FIGS. 1 and 2 the optical fibre 3 is shown extended and hence the physical separation of the sensor stations, indicated by distance 4 is substantially equal to the optical path length of the optical fibre 3. Optical fibre 3 need not be fully extended, in which case the physical separation of the sensor stations, distance 4, may be less than the optical path length of the optical fibre 3. A more extended section of the system showing five sensor stations 2 is shown in FIG. 2.

Each sensor station 2 comprises four fibre optic sensors 5, connected to one another in series and to optical fibre 3 by optical fibre 6. At each sensor station 2 the sensors 5 are deployed in the highway 1 such that there are two sensors, separated as indicated by distance 7, per lane of the highway. Arrows 8 represent the direction of travel of traffic on each lane of the highway. Each sensor is arranged such that its longest dimension is perpendicular to the direction of traffic flow 8, and substantially equal to the width of a lane of the highway. This ensures that a vehicle passing a given sensor station 2 will elicit a response from at least one fibre optic sensor 5, irrespective of its direction of travel or positioning on the lane of the highway. A knowledge of the physical separation of the sensors 7 within each sensor station allows a determination of vehicle speed to be made. All sensor stations are connected by optical fibre 3 to an interferometric interrogation system 9.

Figure 3:
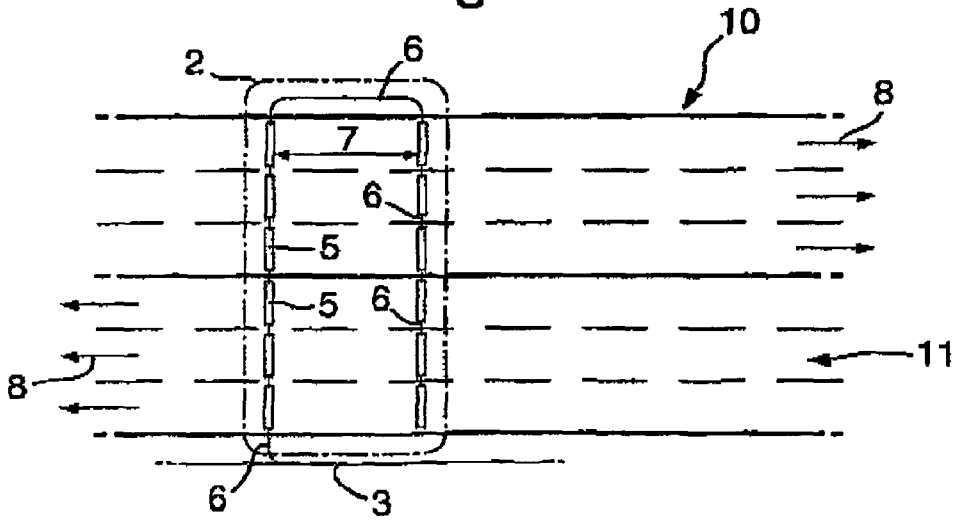
FIG. 3 shows a single sensor station suitable for a traffic monitoring system according to an embodiment of the present invention in place on a six lane highway.

In FIG. 3 a single sensor station 2 is shown in place as part of a traffic monitoring system for a multi-lane highway 10, for example a motorway. In this case twelve sensors 5 are deployed in order to ensure that a vehicle passing the sensor station on any of the six lanes 11 of the highway elicits a response irrespective of its direction of travel 8 or its choice of lane 11.

Figure 4:
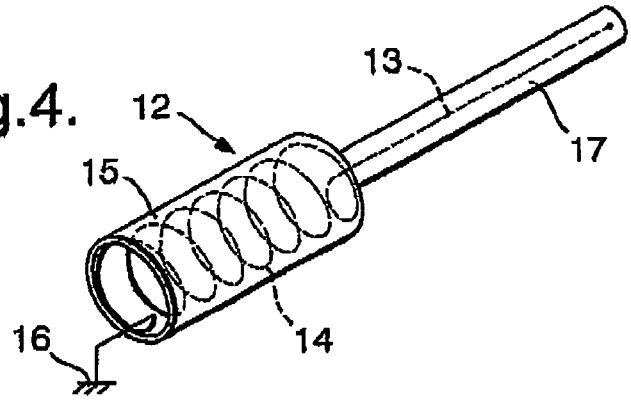
FIG. 4 shows an example of an optical fibre sensor suitable for use in a road traffic monitoring system according to an embodiment of the present invention.
Figure 5A:
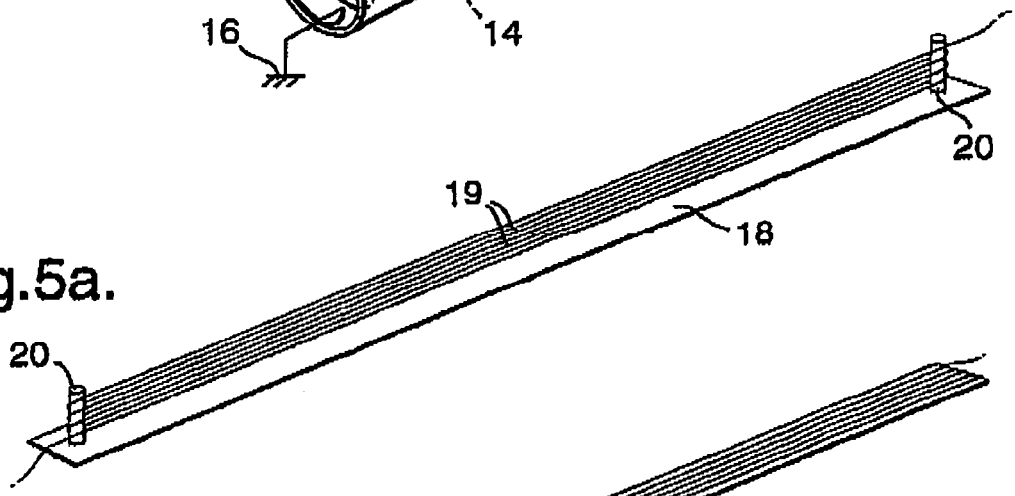
FIGS. 5*a–d* show four further examples of optical fibre sensors suitable for use in a road traffic monitoring system according to an embodiment of the present invention.
Figure 5B:
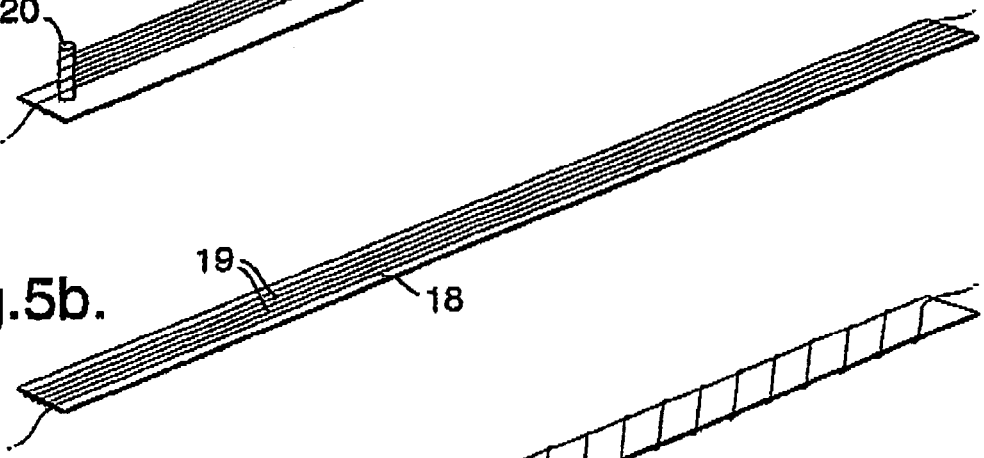
Figure 5C:
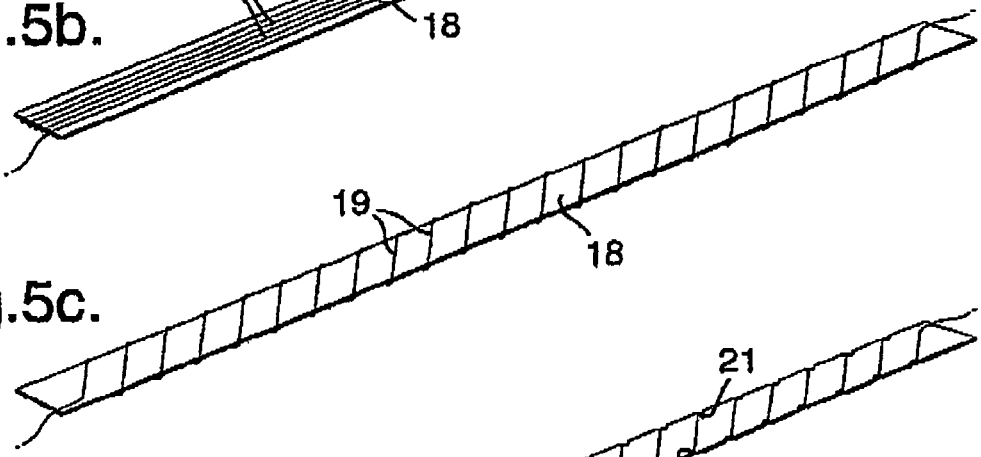
Figure 5D:
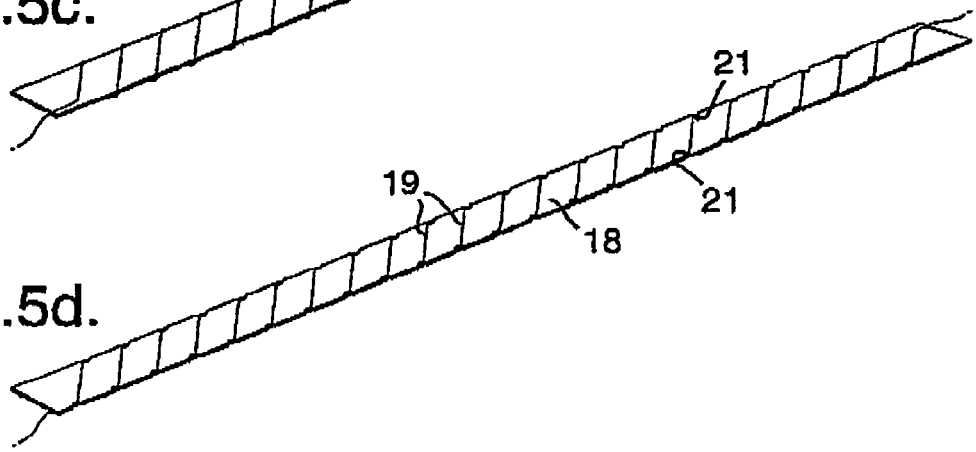

A schematic illustration of a sensor design of embodiments of the present invention is shown in FIG. 4. The sensor 12 comprises a sensing fibre 13 and a dummy fibre 14. In this example the dummy fibre is shown coiled inside a casing 15. A semi-reflective element 16 is coupled to the dummy fibre. This arrangement allows a large length of dummy fibre to be contained in a small volume, thereby reducing the overall size of the sensor. Other arrangements are clearly possible, the dummy fibre may be wound on a reel or former or, if the overall size of the sensor is unimportant, simply left extended. In FIG. 4, a sheath 17 is shown around the sensing fibre 13. This may be separate to, or integral with, the dummy fibre casing 15. The sheath 17 serves to protect the sensing fibre from damage. It may for example, comprise a metal or a plastic. The cross sectional shape of the sheath is preferably chosen such that it provides the sensor with lateral rigidity. In FIG. 4, the sheath is merely illustrated conceptually. Further details of the sheath employed in embodiments of the present invention to protect and support the sensing optical fibre will be provided later with reference to FIGS. 5 and 16.

It is possible, but less preferred, to omit either or both of the casing 15 and the sheath 17. This reduces the cost and complexity of the sensor, but results in a less robust sensor which may be damaged easily.

In use, the sensor is deployed in such a way that the sensing fibre 13 extends across the width of the highway lane to be interrogated. The force exerted by a vehicle passing over the sensing fibre produces a signal which can be detected by the interrogation system. The length of the sensing fibre, typically around 24 m, means that the sensitivity of the sensor is suitable for detecting the large forces associated with the passage of vehicles. The dummy fibre 14 is positioned such that it is not affected by the passage of vehicles. This may be achieved by arranging for the dummy fibre to be at the edge of the highway or between lanes of the highway. The packaging of the dummy fibre may be arranged to insulate the fibre from vibrations.

More details of sensor designs of embodiments of the present invention are shown in FIG. 5. These designs may be used with or without the dummy fibre illustrated schematically in FIG. 4, as appropriate. This design of sensor is based around a thin strip 18 which is commonly a metal strip. The optical fibre 19 is attached to the strip to form the sensor. In FIG. 5*a,* the optical fibre is wound around two spindles 20 attached to each end of the strip. FIGS. 5*b,* 5*c* and 5*d* omit the spindles and have the fibre wound around the strip itself. The fibre may be wound longitudinally, FIG. 5*b,* or helically around the short axis of the strip, FIGS. 5*c* and 5*d.* In FIG. 5*d,* small indents 21 are made into the edges of the strip 18. These are useful in locating the optical fibre as it is wound. In each example, the fibre may be protected by applying a thin overlayer of epoxy or polyurethane (not shown). The use of a thin strip as a former provides sensors which are flexible. This enables them to adopt the camber of the highway into which they are deployed and also allows them to be wound onto a drum for ease of storage and deployment. Clearly, modifications to the design of the sensors shown in FIG. 5 may be made without departing from the scope of the present invention. Indeed, a preferred implementation of the embodiment illustrated schematically in FIG. 5*a* will be discussed later with reference to FIGS. 16A and to 16K. Semi-reflective elements have been omitted from FIG. 5 for clarity.

Figure 6:
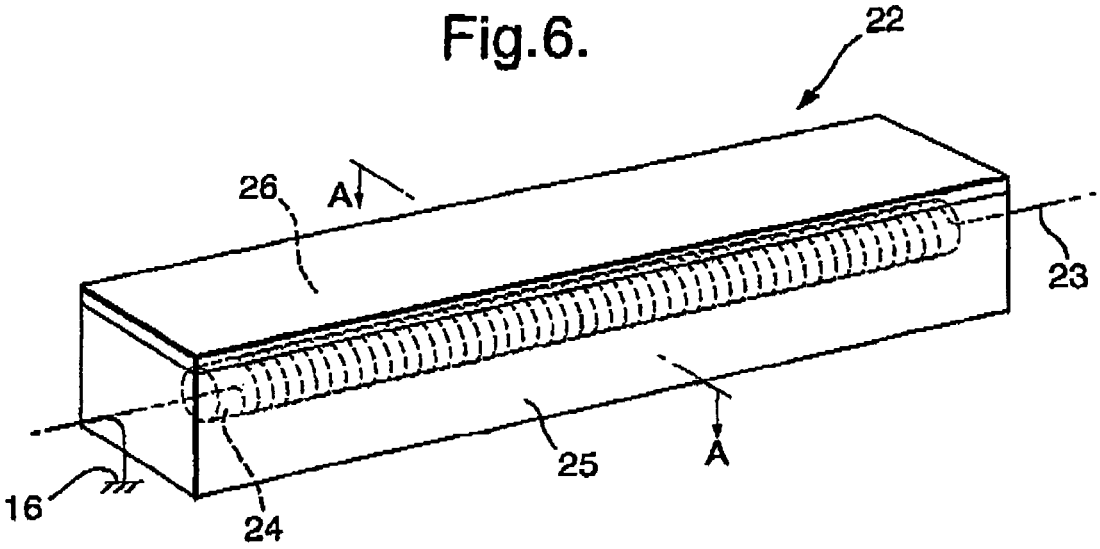
FIG. 6 shows a perspective view of an example of an optical fibre sensor suitable for use in a road traffic monitoring system.
Figure 7:
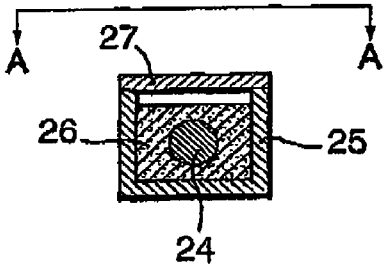
FIG. 7 shows a cross section of the sensor of FIG. 6 taken along the line A—A.

A further example of a sensor 22 shown in FIGS. 6 and 7, comprises an optical fibre 23 which, instead of being wound onto an elongate plate, is wound round a steel bar 24 and placed into a casing 25. In this example the optical fibre 23 is a 50 m length of double coated, high numerical aperture fibre with an outside diameter of 170 μm (FibreCore SM1500-6.4/80), although other lengths and specifications of optical fibre may equally be used. The steel bar 24 is a 3 m length of M12 threaded bar and the optical fibre is wound in co-operation with the thread. This makes it simple to wind the optical fibre evenly along the length of the bar. A 10 mm diameter unthreaded bar can be used in place of the M12 bar, although this makes it more difficult to ensure that the fibre is wound evenly. Alternatively, a more widely spaced, machined helical groove may be used instead of a thread. Clearly, the dimensions of the bar can be altered to provide a sensor of the appropriate size for a desired application. Furthermore, the bar need not comprises a metal bar, suitable alternative materials may include plastics, such as polyurethane and composite materials. A semi-reflective element 16 is coupled to one end of the fibre. If the sensor is to be used in isolation, or if it forms the terminal sensor in a series of sensors, then an additional semi-reflective element is coupled to the other end of the sensor.

In order to reduce the sensitivity of the sensor so that it is suitable for detecting large forces and pressures, a compliant material 26 is provided intermediate the steel bar 24 and the casing 25. This material is able to absorb the majority of any external force applied to the sensor. Unlike traditional optical fibre sensors where high sensitivity is often paramount, this sensor design is deliberately de-sensitised by choosing a compliant material which effectively absorbs the majority of any applied force. This means that a sensor comprising a highly compliant material, such as a grease, may be used to detect larger forces and pressures than would ordinarily be possible with existing optical fibre sensors. During manufacture, it is convenient to partially fill the casing 25 with the compliant material 28 and then place the bar 24 and optical fibre 23 on top. The bar is then overfilled with more of the compliant material. As shown in FIG. 7, this results in the bar being completely surrounded by the compliant material. An optional cap 27 may be provided to protect the sensor. This is useful if the compliant material 26 is chosen to be a soft material such as a grease. It may be possible to omit the cap 27, if the compliant material is one which is designed to set, for example, an epoxy resin.

Figure 9:
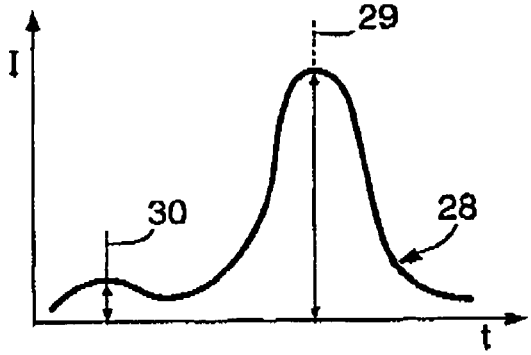
FIG. 9 shows a graphical representation of a typical response of a piezo electric sensor as a vehicle passes over it.

The casing 25 is made from sheet steel, but can be made from any suitable material, such as aluminium, and is conveniently slightly longer than the steel bar 24. FIGS. 6 and 7 show a casing with a substantially rectangular cross section. This shape adds lateral rigidity to the sensor and helps to eliminate a type of signal ambiguity which is often encountered with piezo-electric sensors. This signal ambiguity is illustrated in FIG. 9. The curve 28 of signal strength against time, represents a typical response due to a vehicle passing over a piezo-electric sensor. It consists of two peaks 29, 30. The main peak 29 is produced as the vehicle passes directly over the sensor. It is this part of the signal which is of use. The second smaller peak 30, produced prior to the main peak, is due to the surface of the road being pushed up by the weight of the vehicle as it travels along. This produces what is sometimes referred to as a 'bow wave' which travels ahead of the vehicle. The lateral rigidity afforded by the box shaped cross section of the casing in the present example reduces the effect of the 'bow wave', giving a signal which is representative of a vehicle as it passes directly over the sensor.

Figure 8:
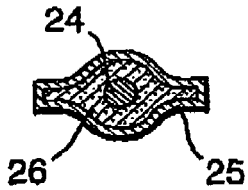
FIG. 8 shows a cross section of an alternative shaped casing suitable for the sensor of FIG. 6.

An alternatively shaped casing which also provides lateral rigidity and hence reduces the 'bow wave' effect is shown in FIG. 8.

Other alternatively shaped casings may be used, for example the casing may comprise a cylindrical tube with an internal diameter slightly larger that the outer diameter of the bar 24. In this case the annular void formed between the bar and the casing would be filled with a compliant material.

In accordance with preferred embodiments of the present invention, rather than using an optical fibre sensor in which the optical fibre is wound around a cylindrical bar, an optical fibre sensor is instead employed of the type described earlier with reference to FIG. 5, in which the optical fibre is wound on an elongate plate. In preferred embodiments, this optical fibre sensor is constructed as shown in FIGS. 16A to 16K.

Figure 16A:
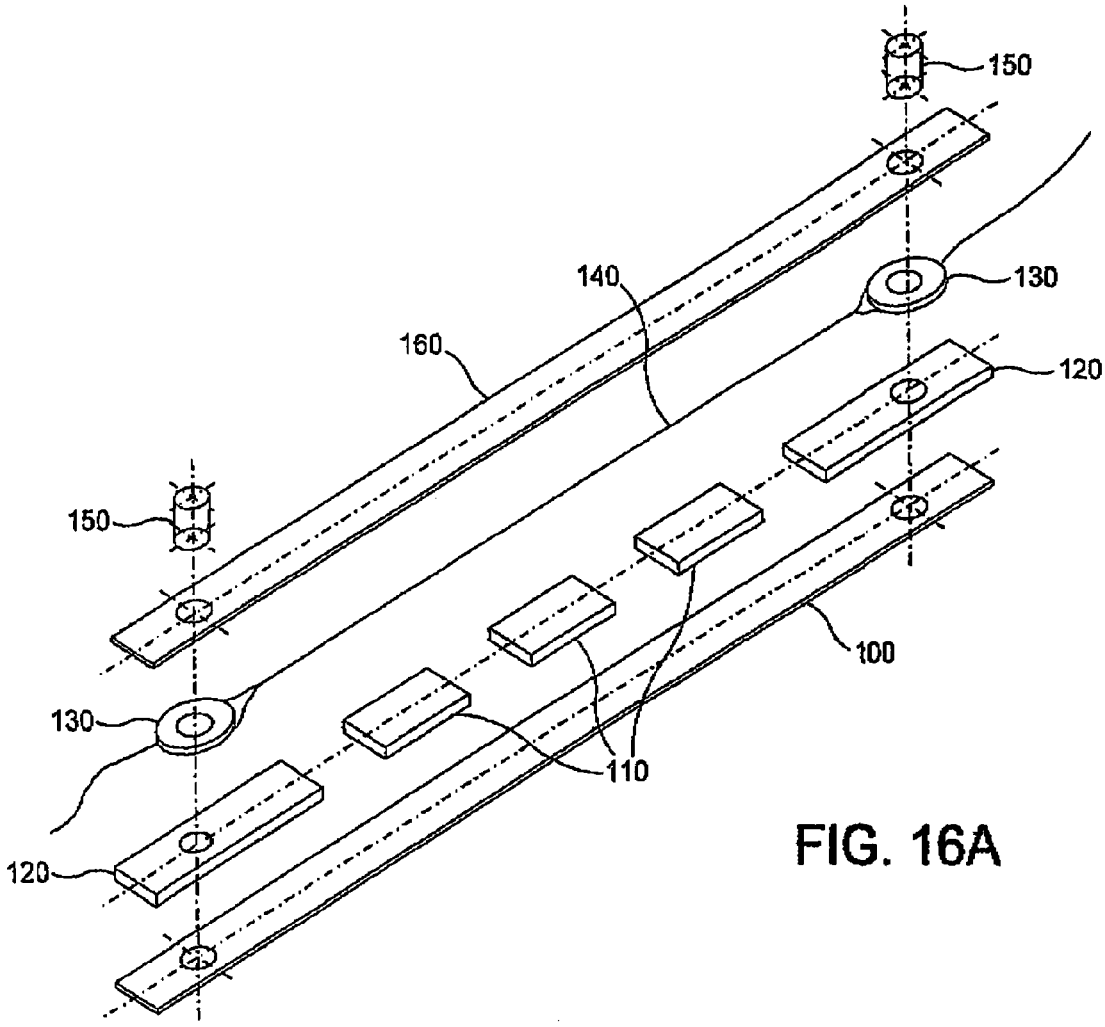
FIGS. 16A to 16K illustrate an optical fibre sensor suitable for use in a road traffic monitoring system according to a preferred embodiment of the present invention.

As shown in FIG. 16A, the optical fibre sensor has a former consisting of an elongate plate 100 upon which are located a number of guide members 110, and a pair of termination plates 120. The guide members 110 and termination plates 120 are merely illustrated schematically in FIG. 16A, with their preferred shape and configuration being discussed later with reference to FIGS. 16C to 16G. In preferred embodiments, the elongate plate 100 has holes provided therein towards opposing ends of the elongate plate, and each termination plate has a corresponding hole provided through it, such that each termination plate is located towards a corresponding end of the elongate plate with the hole in the termination plate being aligned with the hole in the elongate plate. With regard to the guide members, these are spaced along the length of the elongate plate 100, and serve to guide the optical fibre between the two termination plates. The exact number of guide members utilised is a matter of design choice, but in preferred embodiments the guide members are spaced equidistantly between the termination plates.

Each termination plate 120 is configured such that it is arranged to receive a wheel 130, each wheel having a hole therein which is aligned with the hole in the corresponding termination plate 120. As will be described later with reference to FIGS. 16H and 16I, the wheel preferably includes a groove in its circumferential edge which is arranged to receive the optical fibre 140.

A pair of spindles 150 are provided, each being passed through the holes in a corresponding wheel 130, termination plate 120, and end of the elongate plate 100. This spindle serves to locate the various elements in position, and also provides an axis about which the corresponding wheel 130 may rotate.

In accordance with preferred embodiments of the present invention, an optical sensing fibre is passed up and down the length of the elongate plate 100 passing round the circumference of the relevant wheel 130 at the end of each traversal of the elongate plate. The optical fibre 140 is located within the guide members 110 as it traverses the elongate plate to ensure that the optical fibres pass along a predetermined path, preferably this path being along the central axis of the elongate plate. As will be discussed later, the shape of each termination plate 120 is such that it serves to guide the optical fibre from the central axis to the outer circumference of the corresponding wheel 130, and then back towards the central axis of the elongate plate. By providing wheels which are free to rotate whilst the optical fibre is wound thereon, this enables the strain on the various lengths of optical fibre passing between the wheels to be equalised.

Once the optical fibre has been wound between the wheels 130 as described above, then in preferred embodiments the optical fibre is then provided with a coating to both protect the optical fibre and/or desensitise it. In preferred embodiments, the coating is obtained by potting the optical fibre in a compliant potting compound in order to reduce the sensitivity of the optical fibre sensor. The compliant compound may be a highly compliant material, such as grease, or alternatively can be a material which is harder and designed to set, for example, an epoxy resin. In preferred embodiments, polyurethane is used as the compliant compound, which is applied as a liquid and then polymerised.

In preferred embodiments, during manufacture, the elongate plate 100 is placed within a channel to be used as the mould for the resin, preferably this channel being machined out of a metal bar. The termination plates 120 and guide members 110 are then positioned on the elongate plate, as are the wheels 130 and spindles 150, after which the optical fibre 140 is wound between the wheels as described earlier. At this stage, the potting compound is then applied to the components of the optical fibre sensor present in the channel, for example by pouring the potting compound into the channel in the example of an epoxy resin or polyurethane. Typically the potting compound is applied to a level where it will form a flat upper surface for the optical fibre sensor.

Depending on the choice of potting compound, the potting compound itself may be hard enough once set to provide sufficient protection for the optical fibre sensor. However, in preferred embodiments, a second elongate plate 160 is located on top of the potting compound to form an upper surface of the optical fibre sensor. In preferred embodiments, this elongate plate 160 has two holes provided therein to enable the elongate plate to be located on the spindles 150. This arrangement not only provides additional protection for the optical fibres sandwiched between the two elongate plates, but also provides the sensor with symmetry, such that the optical fibre passes generally through the centre of the optical fibre sensor.

When providing the sensor with a second elongate plate, this is preferably applied during manufacture prior to setting of the compliant potting compound, and serves to form a composite "sandwich" with the fibre in the middle suspended in potting compound between the two elongate plates 100, 160. This composite structure is then compressed while the potting compound (e.g. Polyurethane) sets, preferably by attaching a lid to the mould, which then serves as a compression jig. Once cured, the composite structure is removed from the compression jig and is ready for use.

Figure 16B:
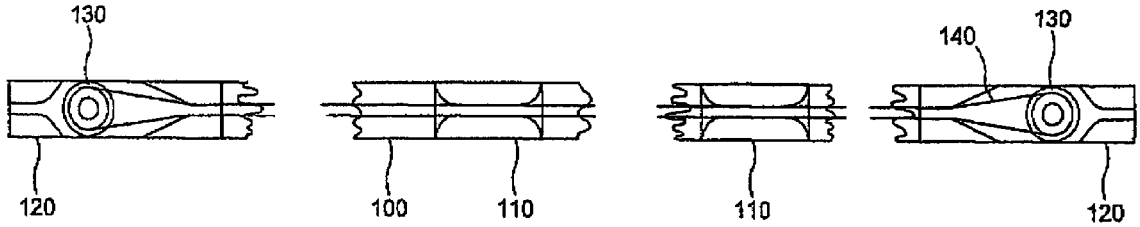

FIG. 16B is an illustration of the optical fibre sensor of FIG. 16A from a top plan view, with the second elongate plate 160 omitted. As can be seen, termination plates 120 are provided at each end of the elongate plate 100 and are arranged to accommodate respective wheels 130. The optical fibre is then passed up and down the length of the elongate plate 100, at each end passing around the circumference of the wheel 130 within a groove provided in the circumferential edge of the wheel 130. The termination plates 120 then serve to guide the optical fibre 140 back towards the central axis of the elongate plate 100, with further guide members 110 being positioned along the length of the elongate plate to guide the optical fibre 140 along the central axis.

Figure 16C:
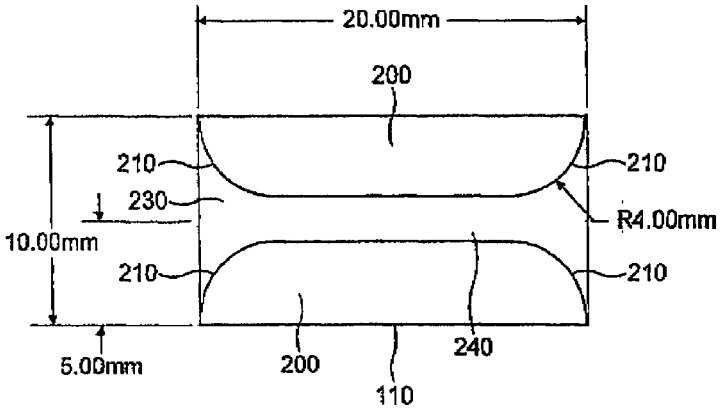
Figure 16D:
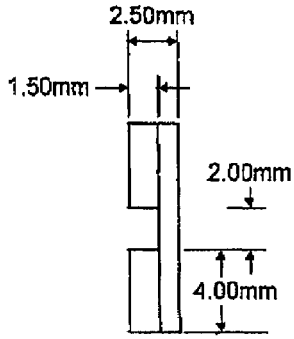
Figure 16F:
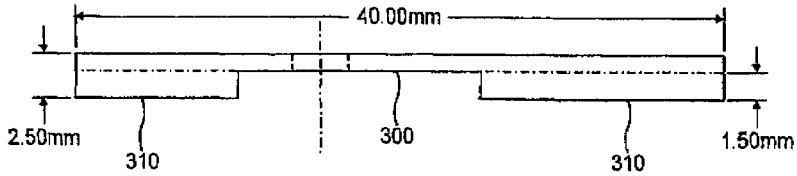
Figure 16E:
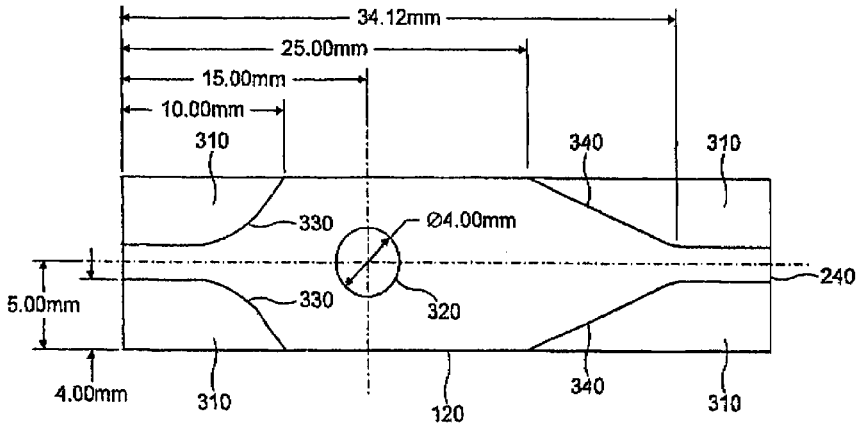
Figure 16G:
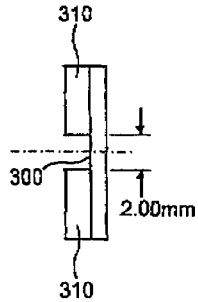
Figure 16H:
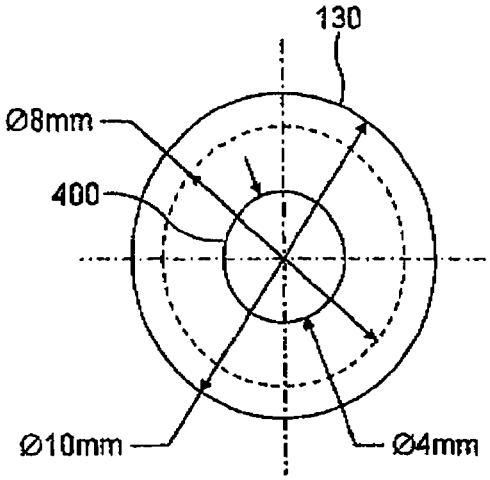
Figure 16I:
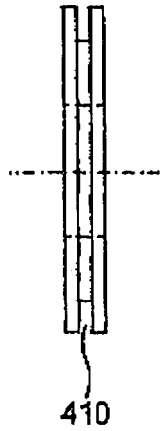
Figure 16J:
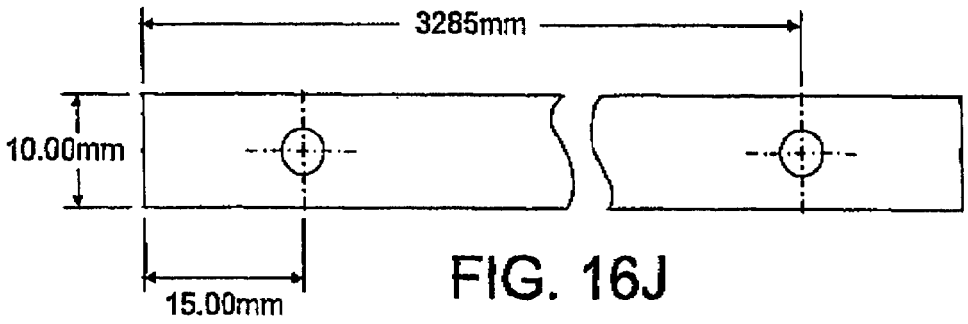
Figure 16K:
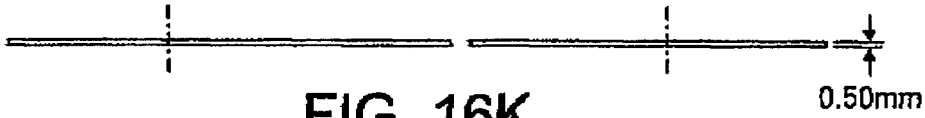

FIGS. 16J and 16K provide details of dimensions of the elongate plate in accordance with preferred embodiments, FIG. 16J providing a plan view and FIG. 16K providing a side view. In preferred embodiments, the elongate plate is formed of a metal strip, for example steel, brass, tin alloys, aluminium alloys, etc. Alternatively, the elongate plate comprises a non-metal strip, for example nylon, polyurethane, etc. As can be seen from FIG. 16J, the elongate plate of preferred embodiments is 3.3 m long with two holes being machined therein 15 mm from each end. In preferred embodiments, the elongate plate is 10 mm wide and 0.5 mm thick.

FIG. 16C illustrates a plan view of the guide member of preferred embodiments, whilst FIG. 16D provides an end view of the preferred guide member. As shown in FIG. 16C, the guide member preferably comprises two raised portions 200 raised above a lower surface 230, each raised portion 200 being provided with a curved edge 210 at each end to serve to align the optical fibre with a groove 240 provided along the length of the guiding member. In preferred embodiments, the guide member is 20 mm long, 10 mm wide, and 2.5 mm deep, with the raised portions 200 being raised 1.5 mm above the lower surface 230.

FIG. 16E illustrates a top plan view of the termination plate 120 of preferred embodiments, whilst FIG. 16F provides a corresponding side view and FIG. 16G provides a corresponding end view. As with the guide members 110, the termination plate has a base 300 with a number of raised portions 310 being provided thereon. A hole 320 is provided within the base 300 to align with the corresponding hole in the elongate plate 100, and arranged to receive a corresponding spindle 150. Each of the raised portions 310 is provided with a shaped edge 330, 340, which serves to guide the optical fibre between the central path 240 and the circumference of a wheel 130 which is centred around the hole 320. A number of dimensions are illustrated on the drawing, all of these dimensions being expressed in millimeters. However, in essence, the termination plate is preferably 40 mm long, 10 mm wide and 2.5 mm deep, with the raised portions 310 being 1.5 mm above the base 300.

FIG. 16H illustrates the wheel of preferred embodiments which is located within the recess 300 of a corresponding termination plate, whilst FIG. 16I illustrates an end view of that wheel. As can be seen from FIG. 16H, the wheel preferably has a diameter of 10 mm, with a circumferential groove 410 of approximately 0.1 mm depth being provided within the circumferential edge. Through the centre of the wheel, a hole 400 is drilled which has the same dimensions as the hole drilled through the base 300 of the termination plate, and again allows the spindle to pass therethrough.

In preferred embodiments, approximately 24 m of high NA fibre is laid along the length of the elongate plate 100 and bent around the 8 mm diameter groove of the wheels 130, thus accommodating approximately 6.5 passes of the fibre along the length of the elongate plate. A reinforced cable and semi-reflective coupler is in preferred embodiments spliced to the optical fibre in a known manner, and potted at one end of the elongate plate, while at the other end the optical fibre is spliced in a known manner into a reinforced cable before being potted.

It will be appreciated that the various example dimensions provided above when describing FIGS. 16A to 16K are merely provided for sake of illustration and could readily be altered without departing from the scope of the present invention.

The sensor design illustrated in FIGS. 16A to 16K has been found to offer a number of technical advantages over the sensor design illustrated earlier with reference to FIG. 6. Firstly, the overall sensor has a depth of approximately 5 mm, which allows a significantly shallower groove to be cut in the surface of the traffic route, and simplifies the positioning of the sensor accurately below the road surface. Furthermore the flexibility of the elongate plates 100, 160 ensures that the sensor is flexible enough to allow it to conform to the contours of the traffic route, for example the camber of a road, and accordingly this design avoids some of the rigidity problems of the design of FIG. 6. Furthermore, whilst the FIG. 6 design did reduce the effect of the "bow wave" due to its lateral rigidity, the design of FIGS. 16A to 16K offers a significantly increased lateral rigidity which significantly further reduces the relative "bow wave" response of the sensor. This is because the horizontal stiffness of the strip is much higher than the vertical stiffness.

It has been found that the sensor design of FIGS. 16A to 16K has all the advantages of size, flexibility and cross axis sensitivity rejection of the best conventional piezoelectric Weigh In Motion (WIM) sensors coupled with the advantages of using a fibre optic sensor. These include the ability to multiplex many sensor together on a single fibre, the ability to interrogate sensors over very large distances, and the increase in reliability due to the removal of all electrical components for the sensor.

Figure 9A:
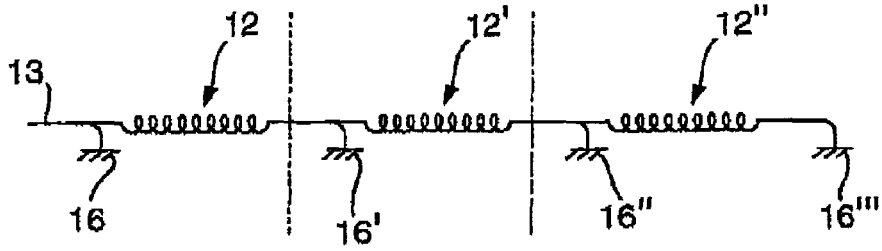
FIG. 9*a* shows a schematic diagram of three sensors connected in series.

In FIG. 9*a,* three sensors 12, 12' and 12" are shown connected in series. In preferred embodiments, each sensor is constructed as shown in FIGS. 16A to 16K. However, any of the other described sensor designs may also be employed. Sensors 12 and 12' each have one semi-reflective element 16 and 16' respectively, coupled to the optical fibre 13. In use, sensor 12 employs both semi-reflective elements 16 and 16'. Similarly, sensor 12' is defined by semi-reflective elements 16' and 16". Sensor 12" is a terminal sensor, hence it has two semi-reflective elements coupled to the fibre 16" and 16'".

Figure 10:
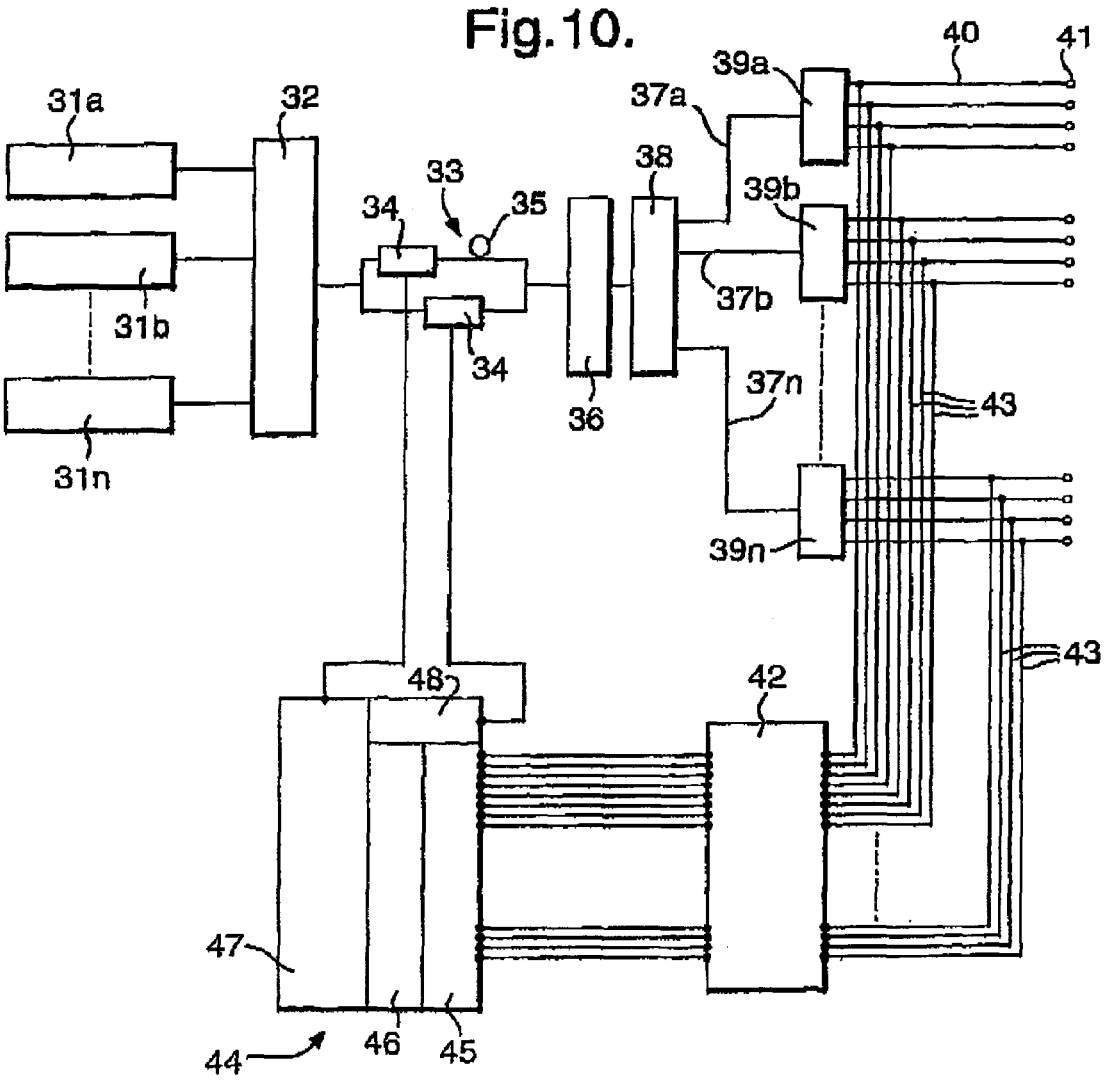
FIG. 10 shows a schematic diagram of an interferometric interrogation system suitable for use in a traffic monitoring system according to an embodiment of the present invention.

FIG. 10 shows an example of an interferometric interrogation system. The architecture of FIG. 10 is based upon a reflectometric time division multiplexed architecture incorporating some additional wavelength and spatial division multiplexing. The light from n lasers 31, for example n distributed feedback (DFB) semiconductor lasers or DFB fibre lasers, is combined using a dense wavelength division multiplexer (DWDM) 32 before passing through an interferometer 33. The interferometer 33 comprises two acousto-optic modulators (AOM) which are also known as Bragg cells 34 and a delay coil 35. Pulses of slightly different frequency drive the Bragg cells 34 so that the light pulses diffracted also have this frequency difference. The output from the interferometer is in the form of two separate interrogation pulses. These are amplified by an erbium doped fibre amplifier (EDFA) 36, and then separated into n different fibres 37 by a second DWDM 38. Each fibre 37 feeds into a 1×N coupler 39. Each coupler 39 splits the input into N fibres 40. In FIG. 10 each coupler 39 is shown as having four output fibres 40, that is N=4. N may be greater or less than this as required. It is also not necessary that all 1×N couplers 39 have the same value for N. Each fibre 40 terminates in a sensor, a group of sensors or a number of groups of sensors 41. It is clear that the number of individual sensors which can be interrogated by the architecture of FIG. 8 may be large. A typical system may have n=8 and N=4 with 5 groups of 8 sensors connected to each output fibre 40. This provides a system where 1280 individual sensors may be interrogated. The maximum number of sensors is limited by the optical power budget, but may be up to several thousand or more.

The return light from the sensors is passed to individual photo-receivers 42 via return fibres 43. The photo-receivers can incorporate an additional polarisation diversity receiver which is used to overcome the problem of low frequency signal fluctuations caused by polarisation fading. This is a problem common to reflectometric time division architectures. Electrical signals are carried from the photo-receivers to a computer 44 which incorporates an analogue to digital converter 45, a digital demultiplexer 46, a digital demodulator 47 and a timing card 48. After digital signal processing within the computer the signal may be extracted as formatted data for display or storage or converted back to an electrical signal via a digital to analogue converter (not shown).

Figure 11:
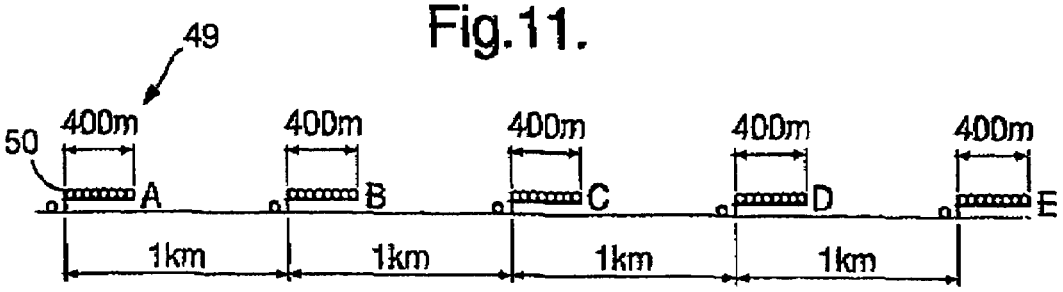
FIG. 11 shows a representation of the spatial arrangement of a set of sensor groups which may be interrogated by the system of FIG. 10.

The success of the architecture of FIG. 10 is critically dependent upon the correct timing of the optical signals. This is achieved by using specific lengths of optical fibre within each sensor, between each sensor within a group of sensors and between each group of sensors. An example arrangement is shown in FIG. 11, where five groups 49 of sensors, each group comprising eight individual sensors 50, are shown separated by a distance of 1 km. Each sensor 50 comprises a total of 50 m of optical fibre so each group 49 has an optical path length of 400 m.

On first inspection it may seem to be necessary to deploy groups of sensors at exactly known and measured intervals, for example every 1 km. This is not the case as delay coils may be used to allow sensor groups to be deployed closer together. If a sensor group cannot be deployed within a set distance then a dummy sensor group consisting of a 400 m coil of fibre could be used and the next group of sensors then deployed on the carriageway. Altering the timing of the interrogation pulses will also allow for various group spacings, for example 500 m, 1 km, 5 km as required.

Figure 12:
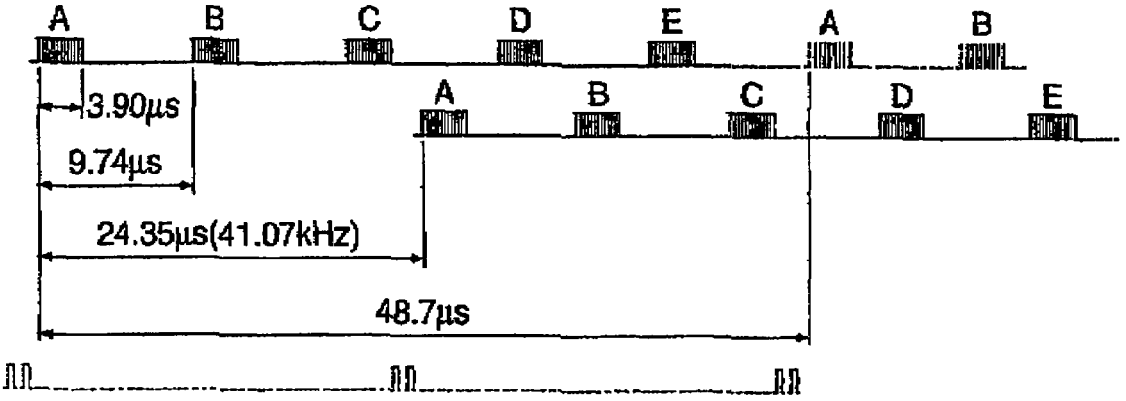
FIG. 12 shows the derivation of the optical signal timings for the set of sensor groups of FIG. 11.

Using the specific fibre lengths defined in FIG. 11, it is possible to define the optical signal timings. This is shown in FIG. 12. This shows that a sampling rate of approximately 41 kHz should be possible for each group of sensors. This results in a high dynamic range over a measurement bandwidth of several kHz at each sensor.

The pulse train to the sensors consists of a series of pulses pairs, where the pulses are of slightly different frequencies. At each end of each sensor is a semi-reflector. The pulse separation between the pulses is such that it is equal to the two-way transit time of the light through the fibre between these semi-reflectors. When these semi-reflectors reflect pulse pairs, the reflection of the second pulse overlaps in time with the reflection from the first pulse from the next semi-reflector along the fibre. The pulse train reflected from the sensor array consists of a series of pulses each containing a carrier signal being the difference frequency between the two optical frequencies. The detection process at the photodiode results in a series of time-division-multiplexed (TDM) heterodyne pulses, each of which corresponds to a particular sensor in the array. When a pressure signal impinges on a sensor it causes a phase modulation of the carrier in the reflected pulse corresponding to that sensor.

To implement the scheme of FIGS. 11 and 12 there is a requirement to generate accurate timing pulses as well as a reasonably sophisticated demultiplexing and demodulation process. By using a computer equipped with analogue to digital converters and able to perform digital signal processing, it is possible to do all of the necessary processing in the digital domain. This improves bandwidth and dynamic range when compared to more conventional analogue approaches.

Figure 13:
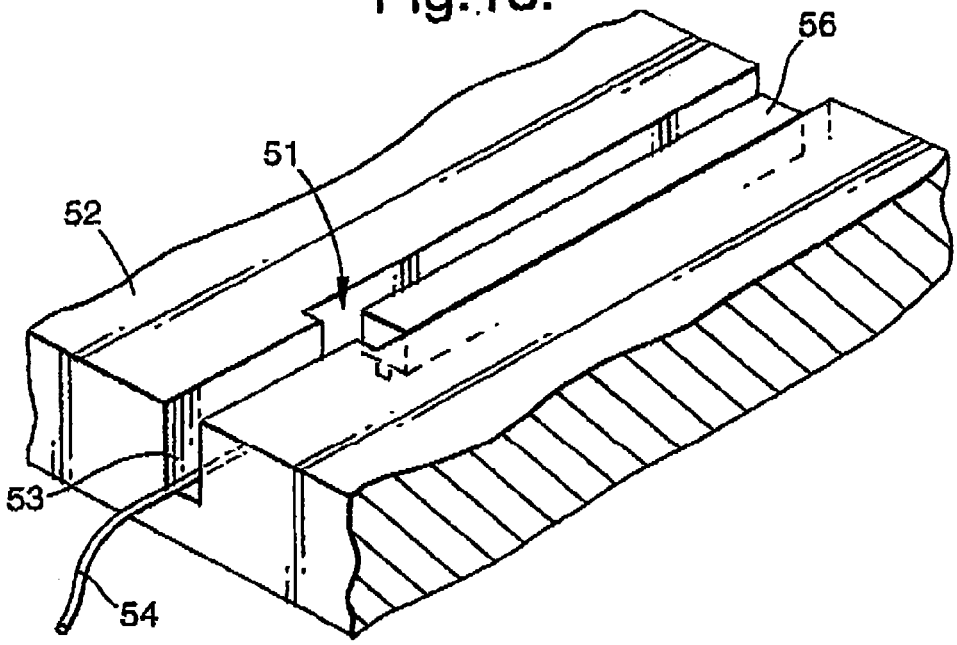
FIG. 13 shows a perspective view of a sensor of the type shown in FIG. 6, deployed beneath the surface of a highway.
Figure 14A:
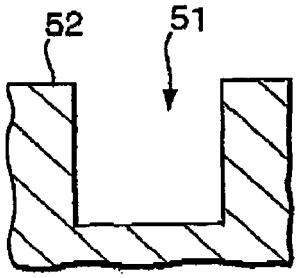
FIGS. 14*a–e,* illustrates how a sensor may be deployed beneath the surface of a highway; and, FIGS. 15*a–b* show the signals recorded from a car and an HGV passing over a sensor of the type shown in FIG. 6.
Figure 14B:
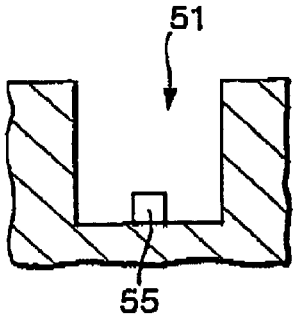
Figure 14C:
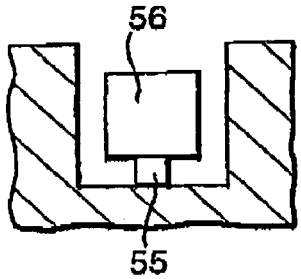
Figure 14D:
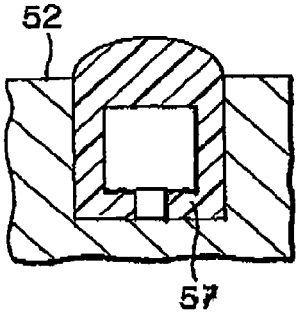
Figure 14E:
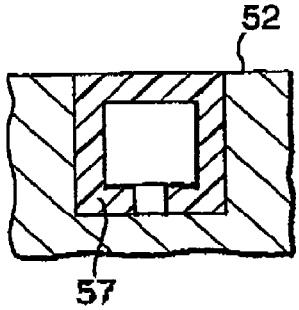

FIGS. 13 and 14 show one example of how sensors may be deployed beneath the surface of a highway. Whilst FIGS. 13 and 14 show the sensor of FIGS. 6 and 7, it will be appreciated that the same basic deployment technique can also be used for the sensor designs of FIGS. 5 and 16. A slot or groove 51 is cut into the surface of a highway 52 using a disk cutter. The groove, which is usually slightly longer than the sensor, includes a thinner section 53 used as a channel to accommodate a lead out optical fibre 54. FIG. 13 shows only a lead out groove from one end of the sensor, clearly a similar groove would be cut at the other end of the sensor to enable two sensors to be connected together. Stand off blocks 55 are placed at intervals along the base of the groove, suitably every 0.5 m or so. The sensor 56 is then deployed on top of the stand off blocks 55. The stand off blocks ensure that the sensor is not directly in contact with the base of the groove thereby helping to insulate it from vibrations. Once the sensor is in place, a potting resin 57 is poured into the groove so that the sensor is completely encapsulated. The stand off blocks allow the potting resin to flow beneath the sensor. Preferably, the groove is slightly overfilled with potting resin as shown in FIG. 14*d*. After a final operation to grind the surface of the resin flush with the surface of the highway, the sensor is suitable for use.

When deploying "strip" sensors of the type illustrated in FIGS. 5 and 16, it may be more appropriate to use clips that would support the sensors flush with or just below the traffic route surface, instead of using stand off blocks 55, since this is envisaged to be a better and easier solution than using stand off blocks.

EXAMPLE 1

Figure 15A:
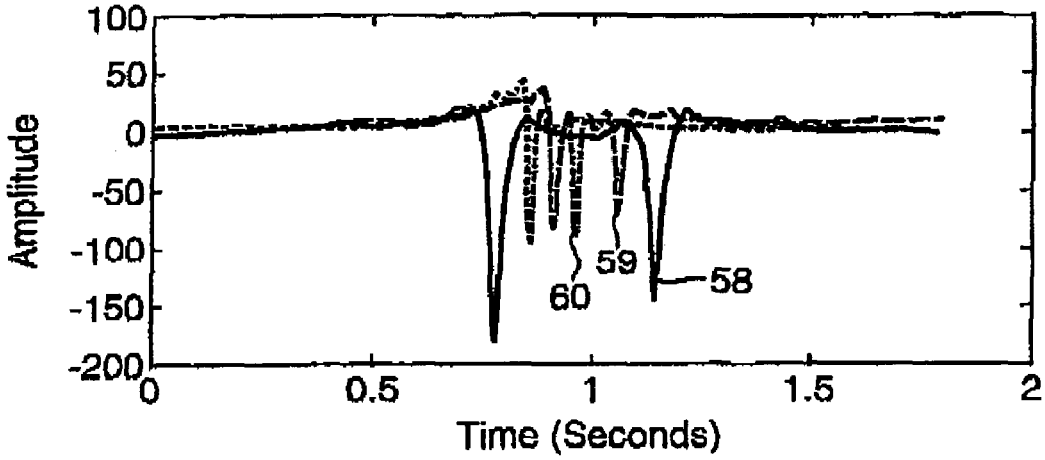

A single sensor of the type shown in FIG. 6, was deployed in a highway as described in FIGS. 13 and 14. FIG. 15*a* shows the response of the sensor as a car is driven over it at three different speeds: 15 mph, 30 mph and 55 mph shown by data curves 58, 59 and 60 respectively. Each curve comprises two peaks which correspond to the two axles of the car. The distance between the peaks is representative of the axle separation and the axle weight can be derived as a function of the integrated area bounded by each peak and the vehicle speed. In this example the vehicle weight can be derived as the speed of the vehicle is known. As described previously, at least two sensors, separated by a known distance, are required to measure the speed of a passing vehicle.

EXAMPLE 2

Figure 15B:
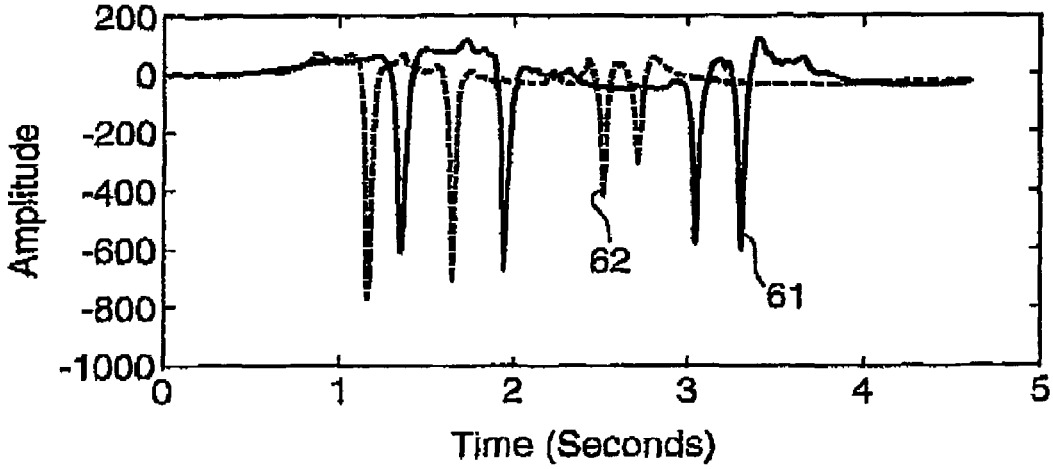

FIG. 15*b* shows the data collected as an articulated vehicle was driven over the sensor used in example 1 above. Data curves 61 and 62 represent a laden vehicle and an unladen vehicle respectively. Each curve comprises four peaks, corresponding to the four axles of the vehicle. Again the axle weight is derived from a knowledge of the vehicle speed and the area bounded by the peaks. In this example, however, as the speed of the vehicle was the same for both the laden test and the unladen test, the numerical difference between the areas bounded by the peaks gives a direct indication of the weight difference of the vehicle. This weight difference is equivalent to the weight of the load carried by the vehicle.

Although a particular embodiment of the invention has been described herein, it will be apparent that the invention is not limited thereto, and that many modifications and additions may be made within the scope of the invention. For example, various combinations of the features of the following dependent claims could be made with the features of the independent claims without departing from the scope of the present invention.

The invention claimed is:

1. An optical fibre sensor for traffic monitoring, comprising:

a former comprising an elongated plate; and an optical fibre wound onto at least one surface of the elongate plate, the elongate plate being flexible in a direction transverse to the at least one surface such that passage of traffic over the optical fibre sensor is arranged to cause a variation in at least one predetermined property of an optical signal transmitted through the optical fibre sensor.

2. An optical fibre as claimed in claim 1, wherein the elongate plate is provided with a pair of curved elements which protrude from the at least one surface and are spaced from each other along the elongate axis, wherein the optical fibre is wound longitudinally between the curved elements.

3. An optical fibre sensor as claimed in claim 2, wherein each curved element is rotatable about an axis transverse to the at least one surface of the elongate plate.

4. An optical fibre sensor as claimed in claim 2, wherein each curved element comprises a spindle.

5. An optical fibre sensor as claimed in claim 4, wherein the spindle is fixed and the curved element further comprises a wheel rotatably mounted on the spindle.

6. An optical fibre as claimed in claim 2, wherein the pair of curved elements are located towards opposing ends of the elongate plate.

7. An optical fibre as claimed in claim 2, further comprising a pair of termination plates provided towards opposing ends of the elongate plate, each termination plate being couple to a corresponding one of the curved elements so as to guide the optical fibre to and from that curved element.

8. An optical fibre sensor as claimed in claim 2, further comprising one or more guide members protruding from the at least one surface of the elongate plate and positioned between the pair of curved elements, the guide members being arranged to guide the optical fibre along a predetermined path on the at least one surface between the pair of curved elements.

9. An optical fibre as claimed in claim 8, wherein the predetermined path is a central path along the elongate axis of the elongate plate.

10. A traffic monitoring system, the system comprising:

at least one sensor station; and an optical interrogation system;

wherein the at least one sensor station comprises at least one optical fibre sensor as claimed in claim 1, the least one optical fibre sensor being deployable in a traffic route;

wherein the optical interrogation system is adapted to respond to the variation in said at least one predetermined property produced in the at least one optical fibre sensor due to a force applied by a unit of traffic passing the at least one sensor station.

11. A system according to claim 10, wherein each sensor is deployed beneath the surface of the traffic route.

* * * * *